US011142417B2

(12) United States Patent
Matsumura et al.

(10) Patent No.: US 11,142,417 B2
(45) Date of Patent: Oct. 12, 2021

(54) SHEET FEEDER APPARATUS

(71) Applicant: CANON KABUSHIKI KAISHA, Tokyo (JP)

(72) Inventors: Koichi Matsumura, Moriya (JP); Satoshi Okuma, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/814,147

(22) Filed: Mar. 10, 2020

(65) Prior Publication Data

US 2020/0290831 A1 Sep. 17, 2020

(30) Foreign Application Priority Data

Mar. 13, 2019 (JP) ..... JP2019-046383

(51) Int. Cl.
*B65H 7/08* (2006.01)
*B65H 5/06* (2006.01)
*B65H 3/06* (2006.01)

(52) U.S. Cl.
CPC ..... *B65H 7/08* (2013.01); *B65H 3/0607* (2013.01); *B65H 5/062* (2013.01)

(58) Field of Classification Search
CPC ..... B65H 9/00; B65H 9/002; B65H 9/106; B65H 7/08; B65H 7/10; B65H 7/14; B65H 5/062; B65H 3/0607
See application file for complete search history.

(56) References Cited

U.S. PATENT DOCUMENTS

| | | | | |
|---|---|---|---|---|
| 7,568,695 | B2 | 8/2009 | Yasukawa et al. | |
| 8,837,017 | B2 | 9/2014 | Murakami | |
| 2011/0215524 | A1* | 9/2011 | Inoue | B65H 7/08 271/228 |
| 2016/0261758 | A1* | 9/2016 | Kimura | H04N 1/0066 |
| 2018/0111773 | A1* | 4/2018 | Yokobori | B65H 9/20 |
| 2019/0112139 | A1* | 4/2019 | Hirayama | H04N 1/00002 |
| 2019/0241384 | A1* | 8/2019 | Terao | B65H 7/10 |

FOREIGN PATENT DOCUMENTS

| | | |
|---|---|---|
| JP | 2006-193287 A | 7/2006 |
| JP | 2012-101900 A | 5/2012 |

* cited by examiner

*Primary Examiner* — Thomas A Morrison
(74) *Attorney, Agent, or Firm* — Venable LLP

(57) ABSTRACT

A sheet feeder apparatus includes a width detector for a sheet placed on a sheet placement portion, a conveyor for conveying sheets while separating the sheets one by one, a first detector for detecting a sheet having a first width at a plurality of first positions, a second detector for detecting a sheet having a second width that is not detected by the first sheet detector at a plurality of second positions, and a controller for determining skewing of a sheet based on a result of the detection of the sheet performed by the first detector if the width of the sheet is the first width, and determining skewing of a sheet based on a result of the detection performed by the second detector if the width of the sheet is the second width.

14 Claims, 13 Drawing Sheets

SHEET FEEDER APPARATUS

BACKGROUND OF THE INVENTION

Field of the Invention

The present invention relates to a sheet feeder apparatus for feeding originals.

Description of the Related Art

Ordinarily, an image reader device is known that is arranged in an upper portion of an image forming apparatus and reads images in originals. The image reader device has an ADF (Auto Document Feeder) for feeding originals placed on an original tray while separating the originals one by one. The ADF cannot separate and feed so-called bound originals, such as stapled originals and glued originals, and if originals to be conveyed are bound originals, the originals may be wrinkled or torn in a mechanism in the ADF for separating originals. Also, if bound originals are fed as-is without being separated in the ADF, there is concern that jamming will occur on a conveyance path.

When bound originals are fed by the ADF, only the uppermost sheet of the bound originals is picked up and fed to the conveyance path by a pick-up roller provided in the ADF. However, the uppermost sheet is bound by a staple or the like, and thus rotates and skews around the position of stapling or the like. A technology for stopping feeding originals upon skewing of an original being detected is known (Japanese Patent Laid-Open No. 2012-101900). Also, an image reader device is proposed in which a plurality of original detection sensors are arranged in the width direction of an original conveyance path, skewing of a conveyed sheet is detected by these original detection sensors, and jamming caused by bound originals is determined (Japanese Patent Laid-Open No. 2012-101900, Japanese Patent Laid-Open No. 2006-193287).

With the technology in Japanese Patent Laid-Open No. 2012-101900, skewing of originals with different sizes in the width direction cannot be detected accurately. That is to say, to increase the detection accuracy, it is effective to increase the distance in the width direction between two sensors for detecting skewing. However, if the distance between the sensors is increased, then small-size originals cannot be detected.

In Japanese Patent Laid-Open No. 2006-193287, a plurality of, namely three or more paper detection sensors are arranged in a line. A plurality of skew angles are obtained with respect to a plurality of detection sections based on differences in time when a sheet leading end passes two of the paper detection sensors, in each detection section, and the distance between the two paper detection sensors arranged. Japanese Patent Laid-Open No. 2006-193287 also gives no consideration to handling originals with different width sizes.

SUMMARY OF THE INVENTION

The present invention provides a sheet feeder apparatus capable of accurately detecting a plurality of bound originals with different sizes.

The present invention has the following configuration. That is to say, according to a first aspect of the present invention, there is provided a sheet feeder apparatus comprising: a width detection unit configured to detect a width of a sheet placed on a sheet placement portion; a conveyance unit configured to convey sheets placed on the sheet placement portion while separating the sheets one by one; a first sheet detection unit configured to detect a sheet having a first width conveyed by the conveyance unit, at a plurality of first positions that differ from each other in a width direction perpendicular to a conveyance direction; a second sheet detection unit configured to detect a sheet having a second width that is conveyed by the conveyance unit and is not detected by the first sheet detection unit, at a plurality of second positions that differ from each other in the width direction; and a control unit configured to determine skewing of a sheet based on a result of the detection performed by the first sheet detection unit if the width of the sheet detected by the width detection unit is the first width, and determine skewing of a sheet based on a result of the detection performed by the second sheet detection unit if the width of the sheet detected by the width detection unit is the second width.

According to a second aspect of the present invention, there is provided a sheet feeder apparatus comprising: a width detection unit configured to detect a width of a sheet placed in a sheet placement portion; a conveyance unit configured to convey sheets placed on the sheet placement portion while separating the sheets one by one; a first sheet detection unit configured to detect a sheet having a first width conveyed by the conveyance unit, at a plurality of first positions that differ from each other in a width direction perpendicular to a conveyance direction; a second sheet detection unit configured to detect a sheet having a second width that is conveyed by the conveyance unit and is not detected by the first sheet detection unit, at a plurality of second positions that differ from each other in the width direction; and a control unit configured to cause the conveyance unit to stop conveying a sheet based on a result of the detection performed by the first sheet detection unit if the width of the sheet detected by the width detection unit is the first width, and cause the conveyance unit to stop conveying a sheet based on a result of the detection performed by the second sheet detection unit if the width of the sheet detected by the width detection unit is the second width.

According to the present invention, feeding of a plurality of bound originals with different sizes can be detected accurately.

Further features of the present invention will become apparent from the following description of exemplary embodiments (with reference to the attached drawings).

DESCRIPTION OF THE EMBODIMENTS

Figure 1A:
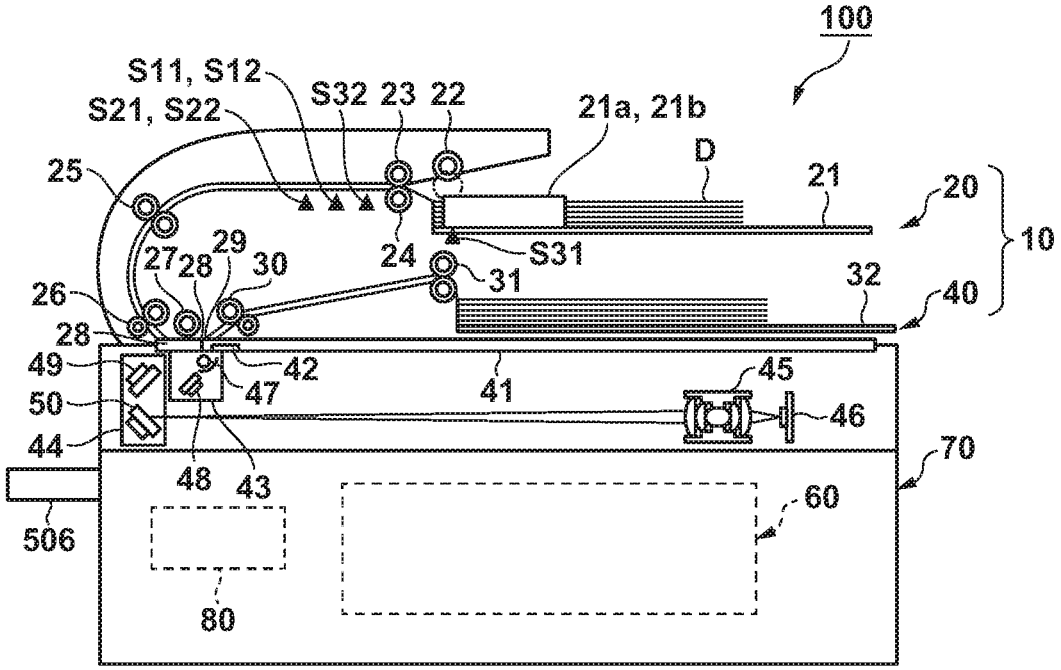
FIG. 1A is an overall schematic diagram showing an image forming apparatus.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are given to the same or similar configurations, and redundant description thereof is omitted.

First Embodiment

Figure 1B:
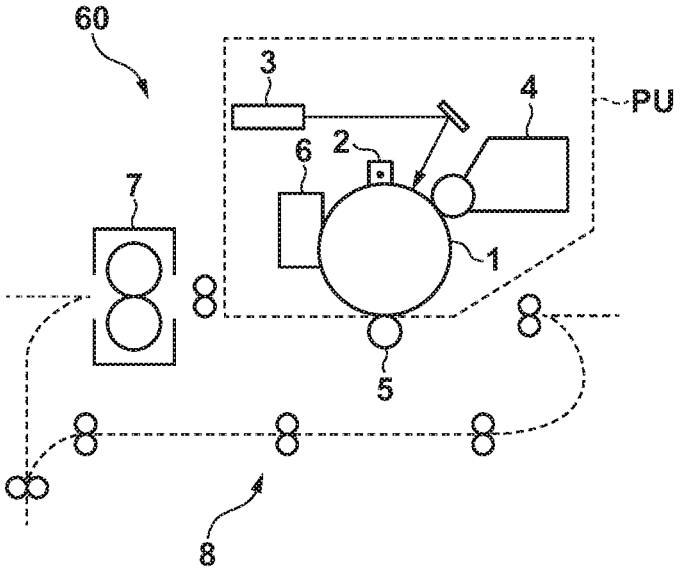
FIG. 1B is a schematic diagram of an image forming engine.

First, the first embodiment of the present invention will be described. An image forming apparatus 100 according to the first embodiment is, for example, a multifunction machine or a multifunctional copier that has an image scanner and a printer, and has an electrophotographic laser beam printer as a printer. FIG. 1A is an overall schematic diagram of the image forming apparatus 100, and FIG. 1B is a schematic diagram of an image forming engine. As shown in FIG. 1A, the image forming apparatus 100 includes an image forming apparatus body 70, and an image reader device 10 that is attached to an upper portion of the image forming apparatus body 70. Note that, in the following description, a "sheet" may include not only plain paper but also special paper such as coated paper, a recording material with a special shape, such as an envelope or an index paper, a plastic film for an overhead projector, cloth, and so on, and an original is also an example of a sheet. In addition, a paper feeder device for receiving print sheets placed thereon and a postprocessing device for performing postprocessing such as stapling may also be provided, but are omitted here. An original may be referred to as an original copy.

The image forming apparatus body 70 contains an image forming engine 60. As shown in FIG. 1B, the image forming engine 60 includes an electrophotographic image forming unit PU and a fixing device 7. If an instruction to start an image forming operation is given, a photosensitive drum 1, which is a photoreceptor, rotates, and the drum surface is uniformly charged by a charging device 2. Then, an exposure device 3 modulates a laser beam based on image data transmitted from the image reader device 10 or an external computer and outputs the modulated laser beam, and scans the surface of the photosensitive drum 1 to form an electrostatic latent image thereon. This electrostatic latent image is visualized (developed) by toner supplied from a developing device 4 and is rendered into a toner image.

In parallel with this image forming operation, a feeding operation to feed a sheet placed in a paper feed cassette or a manual feed tray provided in a paper feeder device (not shown) toward the image forming engine 60 is performed. The fed sheet is conveyed through a conveyance path 8 or the like in accordance with the progress of the image forming operation performed by the image forming unit PU. The toner image carried by the photosensitive drum 1 is transferred onto the sheet by a transfer roller 5. Toner that remains on the photosensitive drum 1 after the toner image has been transferred is collected by a cleaning device 6. The sheet to which an unfixed toner image has been transferred is delivered to the fixing device 7, and is sandwiched by a roller pair to be heated and pressed. The sheet to which the toner has been melted and fixed and an image has been fixed is discharged by a discharging means, such as a discharge roller pair.

The image forming apparatus 100 also includes a control portion 81 for controlling the entire apparatus and an operation portion 506 with which an operator performs operations. The control portion 81 includes a CPU for executing programs and a memory for storing the programs and data.

Image Reader Device

Configuration of Image Reader Device 10

Next, the image reader device 10 will be described in detail. As shown in FIG. 1A, the image reader device 10 includes a sheet feed unit (Auto Document Feeder: also called "ADF") 20 for feeding placed originals one by one, and a reader unit (also called "original reader unit) 40 for reading originals conveyed by the ADF 20. The ADF 20, which serves as a sheet feeder device, is rotatably supported with respect to the reader unit 40 by a hinge such that an original glass 41 of the reader unit is exposed. Note that originals D, each of which is an example of a sheet, may be white paper, or may be paper on which an image is formed on one of or both faces thereof.

The ADF 20 has an original tray 21, which is a sheet placement portion on which a bundle of originals is placed, regulating plates 21*a* and 21*b*, which are arranged at two original-end portions (in the distal direction of the diagram) on the original tray 21 and can be moved so as to come into contact with the two original-end portions, and a discharge tray 32, on which originals are placed that have been fed from the original tray 21, subjected to image-reading, and then discharged. The ADF 20 also has, as feed rollers, a pick-up roller 22 for sending out the uppermost one of the placed sheets, a separation drive roller 23 and a separation follower roller 24 for separating one sheet from the other sheets. One separated sheet is guided to a reading portion by a conveyance roller pair 25 and a leading roller pair 26, and is discharged to the discharge tray by a leading roller pair 30 and a discharge roller pair 31. The ADF 20 also has an original detection sensor S31 for detecting an original D on the original tray 21, a post-separation sensor S32 that is arranged downstream of the separation drive roller 23 in a sheet feeding direction and detects an original D, and skew detection sensors S11, S12, S21, and S22 that are arranged downstream of the separation drive roller 23 and detects skewing of an original D in an original width direction. The post-separation sensor S32 is located at the center of conveyed sheets in the direction (width direction) perpendicular to a sheet conveyance direction. The skew detection sensors S11, S12, S21, and S22 are arranged symmetrically in the width direction with respect to the post-separation sensor S32. In the conveyance direction, the skew detection sensor S11 and S12 are provided at the same position, and the skew detection sensors S21 and S22 are also provided at the same position. In this example, the pair of skew detection sensors S11 and S12 are located upstream of the pair of skew detection sensors S21 and S22, and are located downstream of the post-separation sensor S32. Note that the skew detection sensors may be sensors for detecting sheets that pass through the conveyance path. Each of the skew detection sensors S11, S12, S21, and S22 turns on when detecting a sheet passing through the conveyance path. Each pair of skew detection sensors are located at the same position in the conveyance direction, and are located at different positions in the width direction. In the width direction, each pair of skew detection sensors are arranged symmetrically with respect to the center of conveyed originals in the width direction.

The reader unit 40 has a platen glass 28, which is located at the position at which an original conveyed by the ADF 20 is to be read, and a jump base 29 for guiding an original that has passed through the platen glass 28 toward the conveyance path. The reader unit 40 also has a reference white plate 42 for shading correction, and an original glass 41 on which originals are placed when in a fixed-original reading mode. A first mirror base 43, a second mirror base 44, a lens 45, and a CCD line sensor 46 are provided. A lamp 47 and a mirror 48 are arranged within the first mirror base 43, and mirrors 49 and 50 are arranged within the second mirror base 44. The first mirror base 43 and the second mirror base 44 can be moved in a sub-scanning direction, which is the left-right direction in the diagram, by a wire and a drive motor (not shown).

The image reader device 10 reads image information from an original D using a flowing-original reading mode, in which images in originals are scanned while originals D placed in on the original tray 21 are fed by the ADF 20, and a fixed-original reading mode, in which an original placed on the original glass 41 is scanned. The flowing-original reading mode is selected if an original D placed on the original tray 21 is detected by the original detection sensor S31, or if a user explicitly gives an instruction to select the flowing-original reading mode through the operation portion 506 or the like of the image forming apparatus body 70.

Reading of Original in Respective Reading Modes

Upon the flowing-original reading mode being executed, the pick-up roller 22, which is supported by an arm (not shown), is lowered and comes into contact with the uppermost original D on the original tray 21. The originals D are then fed by the pick-up roller 22 and are separated one by one by a separation nip N, which is formed by the separation drive roller 23 and the separation follower roller 24 and serves as a separation means. The separation drive roller 23 is made of a rubber material or the like that has friction that is slightly less than that of the separation follower roller 24. A torque limiter is disposed on a drive transmission path to the separation follower roller 24, and the separation follower roller 24 rotates in conjunction with the separation drive roller 23 when one original is fed, and does not rotate when two or more originals are fed. With this configuration, originals can be separated one by one. Note that the separation follower roller 24 may be driven in a direction opposite to the sheet feeding direction.

A leading end and a trailing end of the original that has passed through the separation nip N are detected by the post-separation sensor S32, and serve as references for the timing of lifting and lowering the pick-up roller 22, the timing of starting and stopping driving the pick-up roller 22, and the timing of starting and stopping driving the conveyance roller pair 25.

The original D to be conveyed is conveyed by the conveyance roller pair 25, and is conveyed toward the platen glass 28 by the leading roller pair 26. A platen guide roller 27 is disposed opposing the platen glass 28, and the platen guide roller 27 guides the original D that passes through the platen glass 28 such that this original D is not detached upward from the platen glass 28.

Then, an image on the surface of the original D is read via the platen glass 28 by the reader unit 40. Specifically, the conveyed original D is irradiated with light from the lamp 47, and the reflected light from the original D is guided to the lens 45 via the mirrors 48, 49, and 50. The light that has passed through the lens 45 forms an image on a light receiving portion of the CCD line sensor 46, is then subjected to photoelectric conversion as well as AD conversion, and is transmitted, as image data, to the control unit 80, specifically the CPU 81. Note that the reference white plate 42 serves as a reference for the brightness when the original D is read. The original D that has passed through the platen glass 28 is guided to the leading roller pair 30 by the jump base 29, and is discharged to the discharge tray 32 by the discharge roller pair 31.

On the other hand, the fixed-original reading mode is selected if an original D placed on the original glass 41 is detected by the device, or if the user explicitly gives an instruction through the operation portion 506 or the like of the image forming apparatus body 100. In this case, the original D on the original glass 41 does not move, but the first mirror base 43 and the second mirror base 44 move along the original glass 41. The original D is scanned with light emitted by the lamp 47. Image information that has been subjected to photoelectric conversion by light-receiving elements of the CCD line sensor 46 is transferred to the CPU 81.

The two modes differ from each other regarding whether an original or the light source moves, but in the both modes, raster image data, for example, is generated by scanning an original image.

Skew Detection Mechanism

Figure 2:
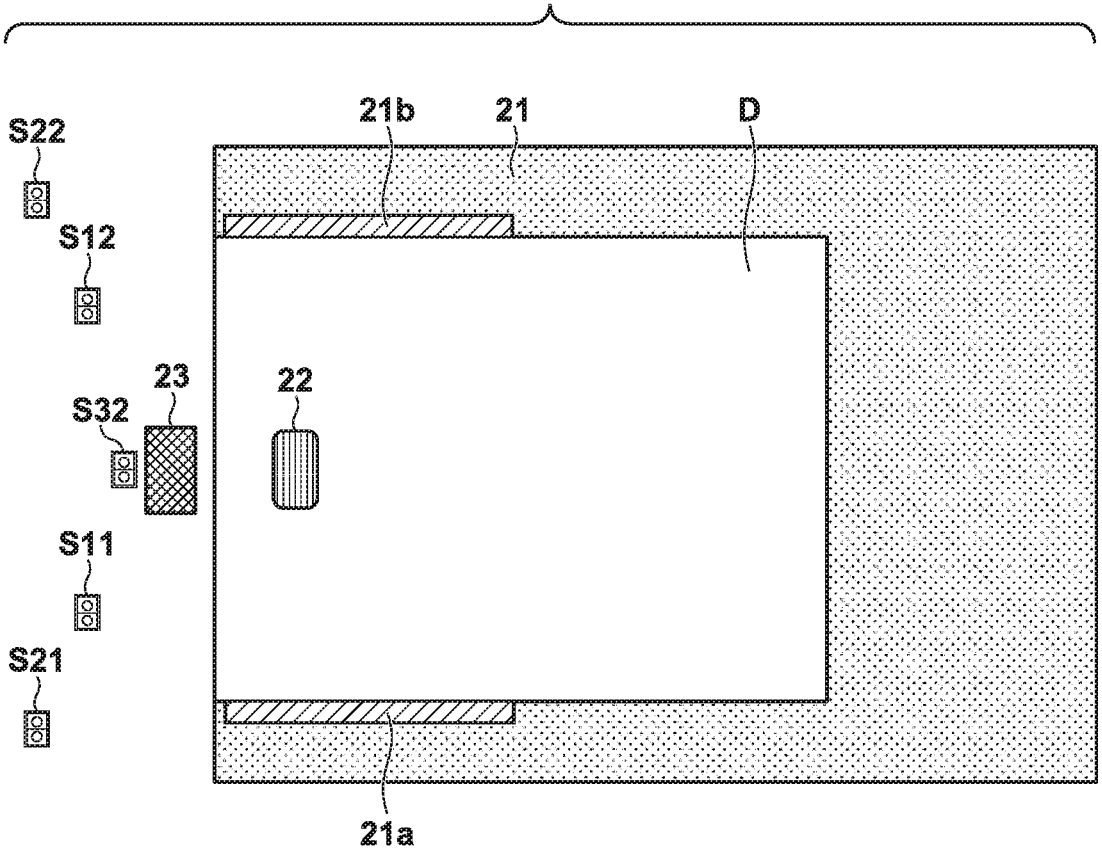
FIG. 2 is an illustrative diagram of a skew detection portion according to a first embodiment.

FIG. 2 shows a skew detection mechanism according to the first embodiment. Note that, although the skew detection mechanism according to the first embodiment is constituted by two sensor pairs, this needs not be the case. The skew detection mechanism is constituted by the skew detection sensor pair S11-S12 and the skew detection sensor pair S21-S22. The skew detection sensor pair S11-S12 is arranged downstream, in the paper feeding direction, of the separation drive roller 23 and the post-separation sensor S32, and the skew detection sensor pair S21-S22 is arranged downstream, in the paper feeding direction, of the skew detection sensor pair S11-S12. The skew detection sensor pair S11-S12 is arranged such that the width (210 mm) of the A4R size>the length [S11-S12] between the skew detection sensors S11 and S12, and the skew detection sensor pair S21-S22 is arranged such that the width (297 mm) of the A3 size>the length [S21-S22] between the skew detection sensors S21 and S22>the width (210 mm) of the A4R size. Originals D are placed on an original placement portion 21, and two sides of the originals are aligned by the regulating plates 21*a* and 21*b* on the original tray. The regulating plates 21*a* and 21*b* are interlocked by a link mechanism, for example, such that they are at an equal distance from the center of the sheet conveyance path in the width direction (the position of the post-separation sensor S32 in the width direction). Thus, the sheets placed on the original tray 21 aligned with the regulating plates 21*a* and 21*b* are located at the center of the conveyance path in the width direction. The uppermost paper of the originals D is sent to the position of the separation drive roller 23 by the pick-up roller 22, and is fed thereby. That is to say, if the conveyed sheet is not skewing, an A4R sheet can be detected by the skew detection sensor pair S11-S12 but cannot be detected by the skew detection sensor pair S21-S22. On the other hand, A4 and A3 sheets can be detected by both the skew detection sensor pair S11-S12 and the skew detection sensor pair S21-S22.

Control Block

Figure 3:
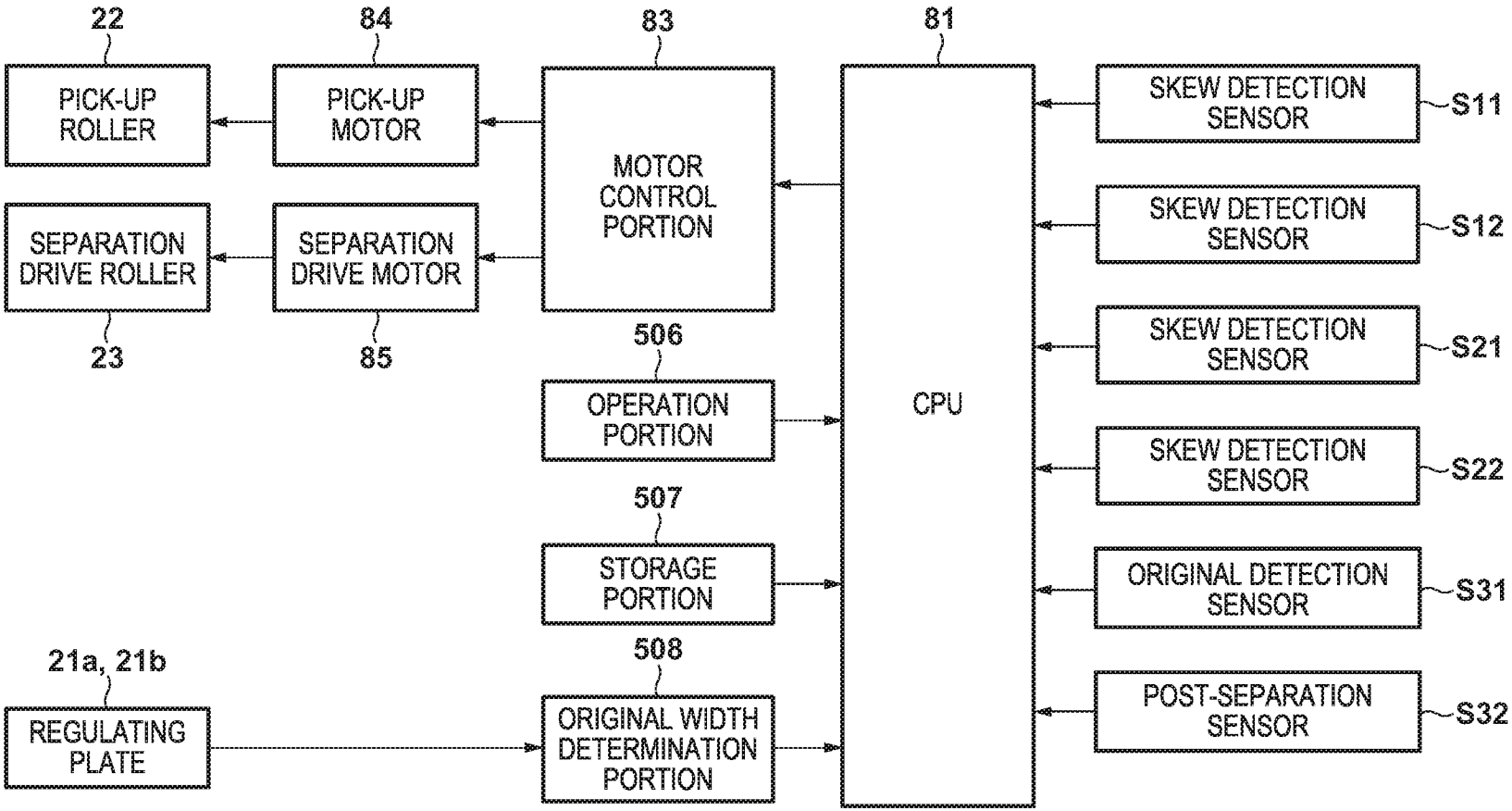
FIG. 3 is a control block diagram according to the first embodiment.

FIG. 3 is a block diagram of the control portion 80. The skew detection sensors S11, S12, S21, and S22, the original detection sensor S31, the post-separation sensor S32, and an original width determination portion (which is also simply called a width determination portion or a width detection portion) 508, each of which serves as an input signal source, are connected to the CPU 81. A value corresponding to the width between the regulating plates 21*a* and 21*b* is input from the original width determination portion 508 to the CPU 81, and thus the width of originals is understood. A pick-up motor 84 and a separation drive motor 85 are connected, via a motor control portion 83, to the output side of the CPU 81. The pick-up motor 84 drives the pick-up roller 22, and the separation drive motor 85 drives the separation drive roller 23. The operation portion 506 and a storage portion 507 are also connected to the CPU 81. The operation portion 506 has an operation panel that is constituted by a touch panel and keys, for example, and makes it possible to start a copy job and configure various settings. A threshold Tth [ms] for detecting skewing of an original using the skew detection sensors S11, S12, S21, and S22 is stored in the storage portion 507. In addition, programs with which the CPU 81 performs processing according to later-described flowcharts are also stored in the storage portion 507. The CPU 81 may also be connected to other sensors and control circuits, but a description thereof is omitted here. Note that the storage portion 507 may include a RAM, a ROM, a hard disk, and the like, and these specific media are properly used in accordance with information to be stored.

Bound Originals Detection Flow

Figure 4:
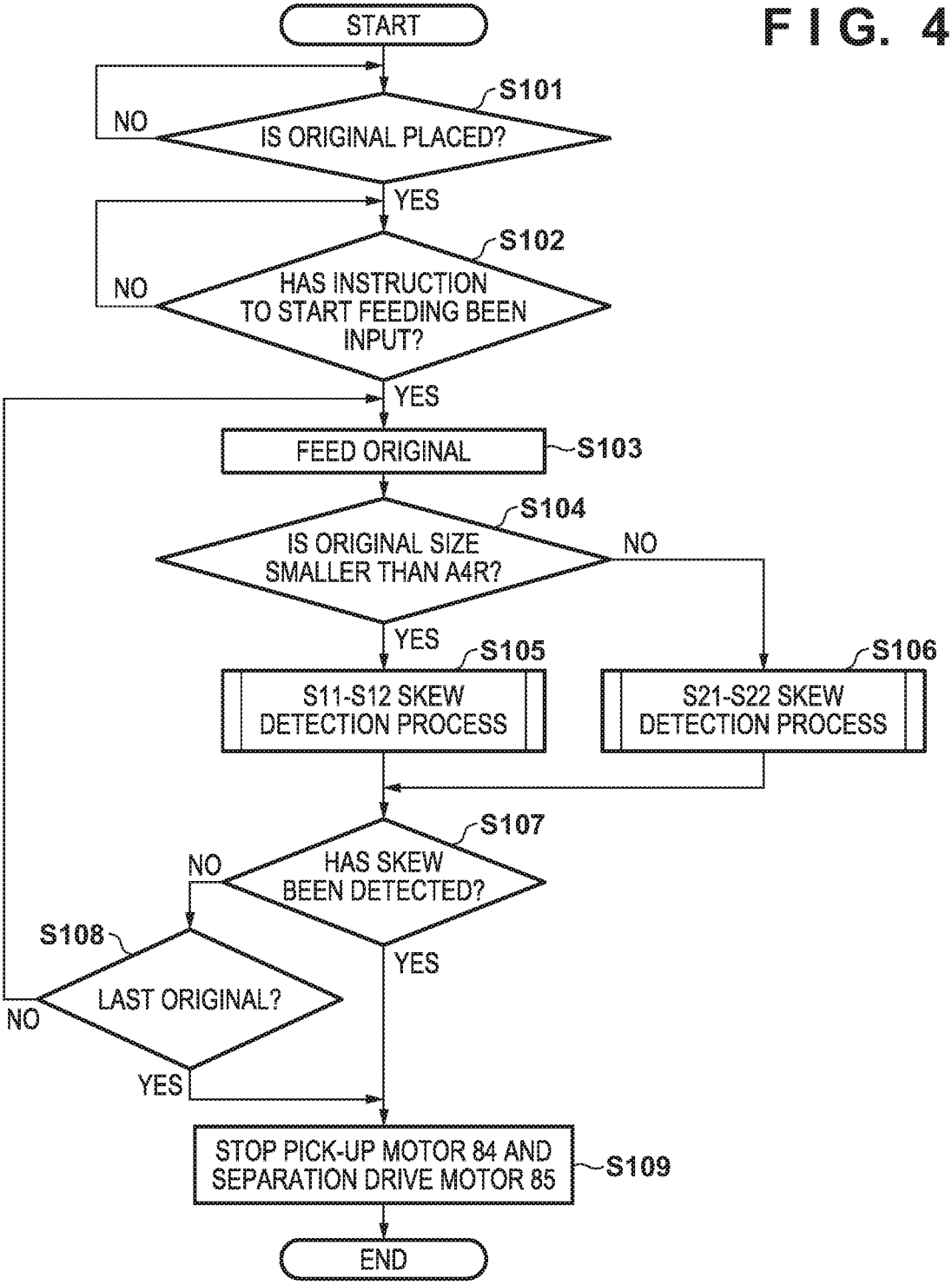
FIG. 4 is a flowchart showing operations according to the first embodiment.

Next, a copying operation performed when bound originals are fed will be described in accordance with a flowchart. FIG. 4 is a flowchart showing the copying operation according to the first embodiment that is performed when originals are fed.

First, the CPU 81 determines whether or not an original is placed on the original tray 21, based on a signal from the original detection sensor S31 (step S101). If it is determined that no original is placed on the original tray 21 (step S101: No), the CPU 81 does not proceed to the next process but waits until an original is placed on the original tray 21.

If it is determined that an original is placed on the original tray 21 (step S101: Yes), the CPU 81 determines whether or not an instruction to start a job that accompanies feeding of an original using the ADF 20, such as a copy job, has been input (step S102). The following description takes a copy job as an example, but jobs that accompany reading of an original, such as scan transmission and facsimile transmission, fall under the job that accompanies feeding of an original. If no instruction to start a copy job has been input from the operation portion 506 (step S102: No), the CPU 81 does not proceed to the next process but waits until an instruction to start a copy job is input. If it is determined that an instruction to start a copy job has been input (step S102: Yes), in step S103, a sheet placed on the original tray 21 starts being fed. Upon paper feeding being started, it is determined whether or not the original size is smaller than the A4R size (step S104). This determination may be made based on the input from the original width determination portion 508.

If the original size is smaller than A4R (step S104: Yes), a skew detection process is carried out by the skew detection sensor pair S11-S12 (step S105). Step S105 will be described later with reference to FIG. 5. If the original size is larger than or equal to A4R (step S104: No), a skew detection process is carried out by the skew detection sensor pair S21-S22 (step S106). Step S106 will be described later. After processing in step S105 or step S106 has been finished, it is determined whether or not skewing has been detected in step S105 or step S106 (step S107). If skewing has been detected in step S105 or step S106 (step S107: Yes), the pick-up motor 84 and the separation drive motor 85 are stopped to stop feeding paper (step S108). If skewing is not detected in step S105 or step S106 (step S107: No), it is determined whether or not the original being conveyed is the last original (step S109). If the original being conveyed is the last original (step S109: Yes), the pick-up motor 84 and the separation drive motor 85 are stopped to stop feeding paper (step S108). If the original being conveyed is not the last original (step S109: No), the processing returns to step S103 to resume feeding the next original.

Thus, skewing is determined based on the result of a skew detection sensor pair corresponding to the original size detecting an original.

Step S105: S11-S12 Skew Detection Process

Figure 5:
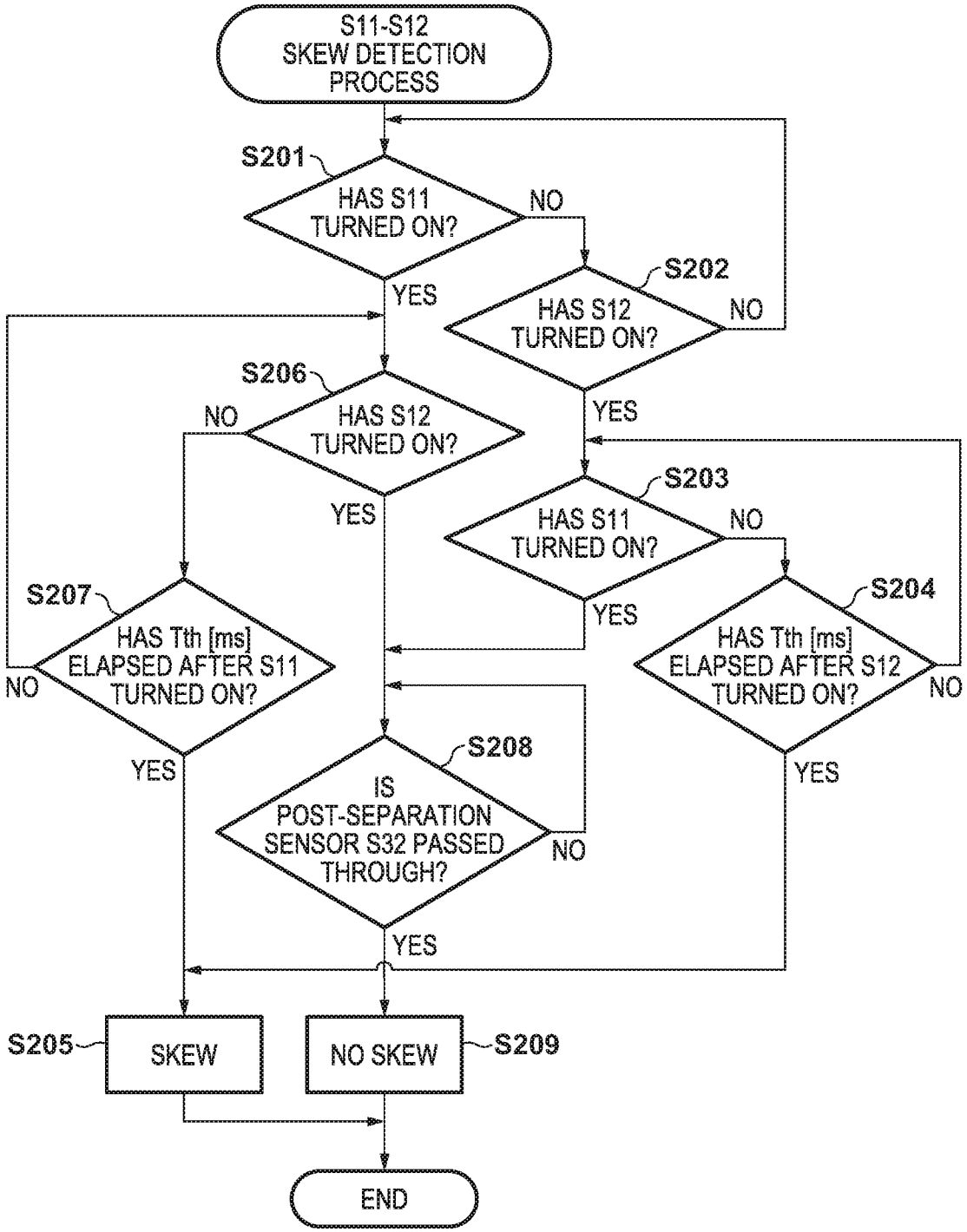
FIG. 5 is a flowchart of an S11-S12 skew detection process according to the first embodiment.
Figure 6A:
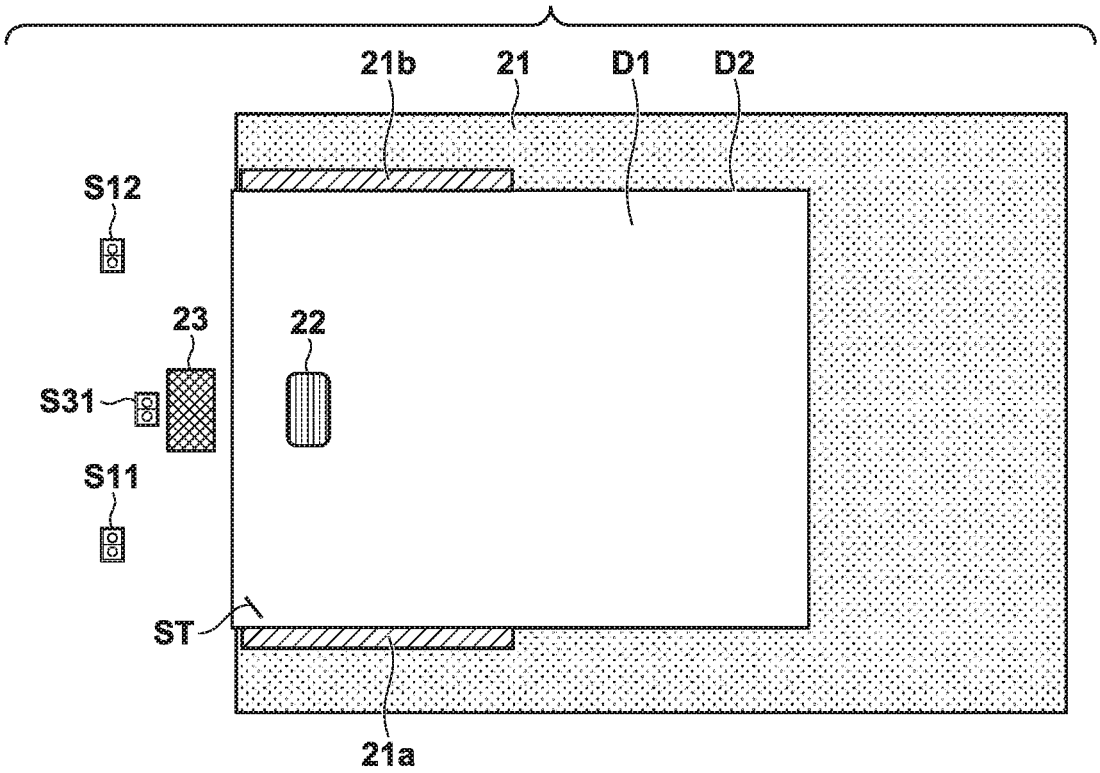
FIG. 6A shows the state before bound originals are fed.
Figure 6B:
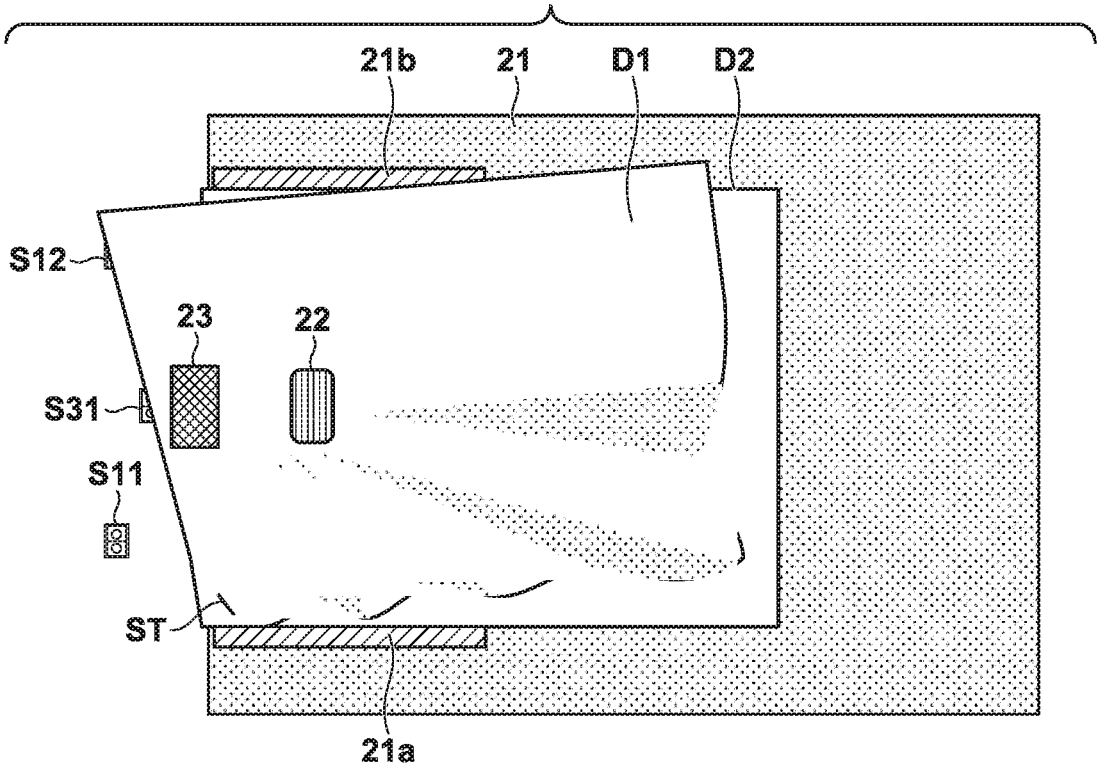
FIG. 6B shows the state after the bound originals have entered a separation drive roller.

The aforementioned step S105: S11-S12 skew detection process will be described in accordance with a flowchart. FIG. 5 is a flowchart showing the S11-S12 skew detection process according to the first embodiment. FIGS. 6A and 6B will be referenced to give a detailed description. FIGS. 6A and 6B show skewing viewed from above that occurs when bound originals are fed. FIG. 6A shows a state where bound originals are placed, and FIG. 6B shows a state where bound originals are fed and skewing occurs. Note that, in this example, the skew detection sensors S21 and S22 are omitted.

A first original D1 and a second original D2, which are bound with a staple ST, are placed as shown in FIG. 6A. Upon paper feeding being started and the bound originals D1 and D2 being advanced to the position of the separation drive roller 23 by the pick-up roller 22, the bound originals D1 and D2 are fed such that the first original D1 and the second original D2 are separated into individual sheets by the separation drive roller 23. However, the first original D1 is advanced by the pick-up roller 22 and the separation drive roller 23, whereas the second original D2 is not conveyed by the separation drive roller 23, and thus, the first original D1 begins to rotate around the staple ST (FIG. 6B). At this time, the side of the first original D1 where it is bound with the staple ST is not conveyed, and therefore the skew detection sensor S11 is in an OFF state. On the other hand, an end portion of the first original D1 on the side where it is not bound with the staple ST is conveyed, and thus the skew detection sensor S12 turns ON. Such a state is entered if stapled originals are conveyed and skewing occurs. For this reason, in step S105, such a situation is determined using the skew detection sensors S11 and S12. Since there may also be the case where originals are stapled on the sensor S12 side, the occurrence of the aforementioned situation is determined line-symmetrically with respect to an axis extending in the conveyance direction.

In FIG. 5, first, it is determined whether or not the skew detection sensor S11 is ON (step S201). If it is determined that the skew detection sensor S11 is not ON, then it is determined whether or not the skew detection sensor S12 has turned ON (step S202: Yes). If, in step S202, the skew detection sensor S12 is ON, the processing proceeds to step S203. In step S203, it is determined whether or not the skew detection sensor S11 turns ON after the skew detection sensor S12 has turned ON in step S202. If it is determined that the skew detection sensor S11 is OFF (step S203: No), there is possibility that a sheet being conveyed is skewing. In this case, it is determined that skewing has occurred if the difference in time when the sheet was detected between the two sensor S11 and S12 exceeds the threshold Tth [ms]. This difference in time indicates a degree of skewing of the sheet. It is then determined whether or not the threshold (predetermined time) Tth [ms], which is stored in the storage portion 507, has elapsed before the sheet is detected by the sensor S11 after the sheet has been detected by the sensor S12 (step S204). Here, the threshold Tth is a value that is determined in accordance with the conveyance speed, and is 30 mS, for example. But this need not be the case. The degree of skewing can be determined based on the tilt of a sheet front edge. The threshold Th is time corresponding to this tilt. The higher the conveyance speed, the shorter the threshold Tth, and the lower the conveyance speed, the longer the threshold Tth. It is determined that skewing has occurred if the difference in the detection timing between the skew detection sensors corresponds to 1 cm in terms of the difference in distance, for example. In this case, the time required to convey the sheet by 1 cm may be used as the threshold Tth. That is to say, Tth may be a value obtained by dividing the difference in distance by the conveyance speed.

If, in step S204, the threshold Tth [ms] has not elapsed (step S204: No), the processing returns to step S203 to determine whether or not the skew detection sensor S11 turns ON. That is to say, the processing loops between steps S203 to S204 until the skew detection sensor S11 turns ON or the time Tth has elapsed. If steps S203 and S204 are repeated and the threshold Tth [ms] elapses (step S204: Yes), it is determined that the original being fed has entered the state shown in FIG. 6B. Then, the determination result indicating that skewing has occurred is stored in a predetermined storage area or the like (step S205), and the S11-S12 skew detection process ends.

If fed originals are not bound originals but normal originals, usually, the skew detection sensor S11 turns ON before the threshold Tth [ms] elapses in step S204 (step S203: Yes), and therefore it is determined that the fed original passes through the post-separation sensor S32 (step S208). Upon the fed original passing through the post-separation sensor S32 (step S208: Yes), the determination result indicating that the original being conveyed is not skewing is stored in a predetermined storage area or the like (step S209), and the S11-S12 skew detection process ends.

On the other hand, if it is determined in step S201 that the skew detection sensor S11 has turned ON, the processing branches to step S206 to determine whether or not the skew detection sensor S12 has turned ON. If it is determined in step S206 that the skew detection sensor S12 is OFF, there is possibility that the sheet being conveyed is skewing. Then it is determined whether or not the threshold Tth [ms] has elapsed before the sheet is detected by the sensor S12 after the sheet has been detected by the sensor S11 (step S207).

If, in step S207, the threshold Tth [ms] has not elapsed (step S207: No), the processing returns to step S206 to determine whether or not the skew detection sensor S12 turns ON. That is to say, the processing loops between steps S206 and S207 until the skew detection sensor S12 turns ON or the time Tth elapses. If steps S206 and S207 are repeated and the threshold Tth [ms] elapses (step S207 Yes), it is determined that the original being fed has entered a state that is an inversion of the state shown in FIG. 6B. Then, the determination result indicating that skewing has occurred is stored in a predetermined storage area or the like (step S205), and the S11-S12 skew detection process ends.

If the fed originals are not bound originals but normal originals, the processing branches to step S208. Processing to be performed thereafter is as described above.

Step S106: S21-S22 Skew Detection Process

This processing is processing in FIG. 5 in which the skew detection sensors S11 and S12 are replaced with S21 and S22. In this example, the threshold Tth may take the same value as that used in the procedure in FIG. 5. The other parts are also the same as those in FIG. 5, and a description thereof is omitted accordingly.

Configuration of Skew Detection Sensor Pair S11-S12 and Skew Detection Sensor Pair S21-S22

Figure 7A:
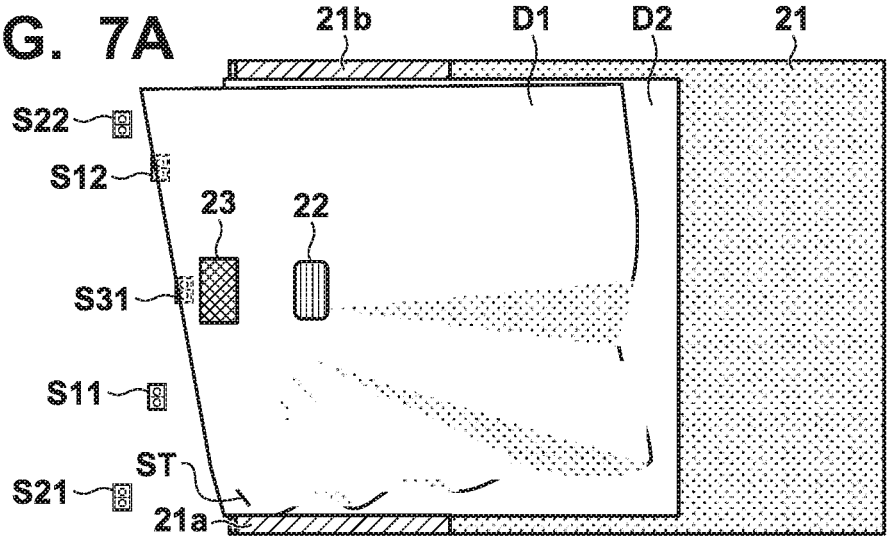
FIG. 7A shows ideal skewing.
Figure 7B:
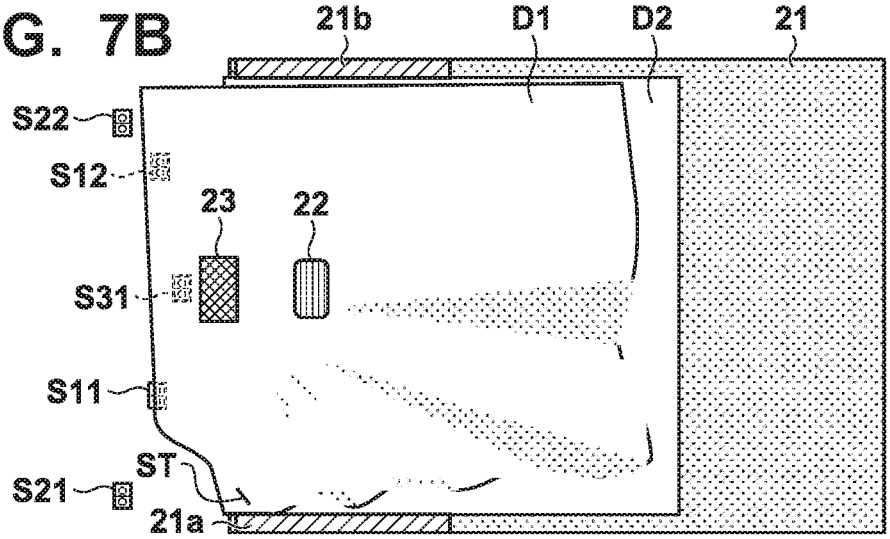
FIG. 7B shows actual skewing.
Figure 7C:
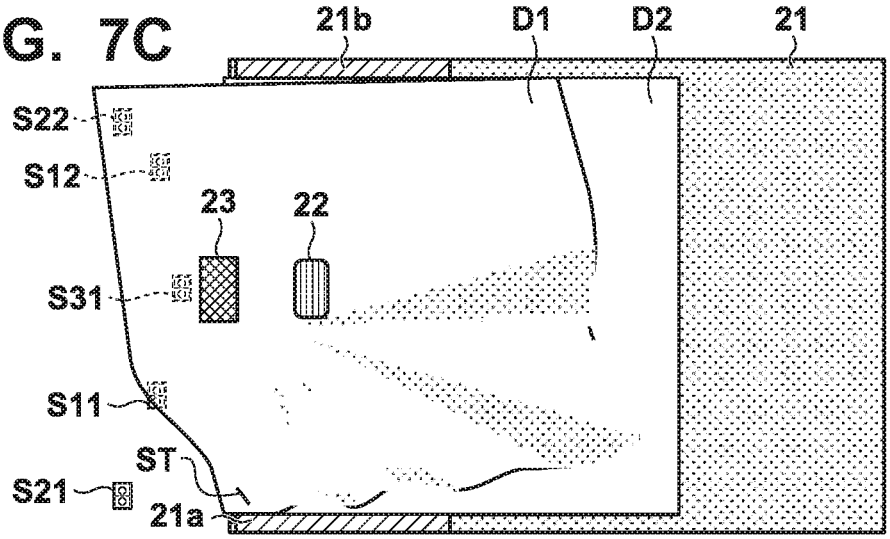
FIG. 7C shows actual skewing after a lapse of time.

The detection method performed using the skew detection sensor pairs S11-S12 and S21-S22 has been described so far, and now, a description will be given below of the reason why two or more skew detection sensor pairs S11-S12 and S21-S22 are needed. FIGS. 7A to 7C show examples of skewing states when bound originals of the A3 size are fed. FIG. 7A shows skewing that does not cause the sheet front edge to distort and is ideal for detection, FIG. 7B shows a state in which skewing has begun to occur and the sheet front edge has bent and that often occurs in reality, and FIG. 7C shows a state in the case where conveyance is continued from the state in FIG. 7B. The skew detection sensor pair S11-S12, the skew detection sensor pair S21-S22, the separation drive roller 23, the post-separation sensor S32, the original placement portion 21, and the regulating plates 21*a* and 21*b* on the original tray have respective configurations and functions that have been described with reference to FIG. 2. Skewing that is ideal for detection when bound originals are fed is shown in FIG. 7A, where the first original D1 rotates around the staple ST, and the original leading end is linear with respect to the staple ST. However, in reality, the portion of the first original D1 where the staple ST is present remains at the position of the separation drive roller 23, whereas the side of the first original D1 where the staple ST is not present is often conveyed along the regulating plates while remaining parallel to the conveyance path to some extent, as shown in FIG. 7B. Thus, skewing does not significantly occur on the inner side of the original where the skew detection sensor pairs S11-S12 is present. Accordingly, to detect skewing of a larger-size original, not only the skew detection sensor pair S11-S12 but also the skew detection sensor pair S21-S22 are needed. If time passes from the state in FIG. 7B, the side of the first original D1 where the staple ST is not present proceeds and enters the state shown in FIG. 7C, turning ON the skew detection sensor S22 on the outer side, and thus, skewing of a larger-size original can be detected.

Second Embodiment

Figure 8:
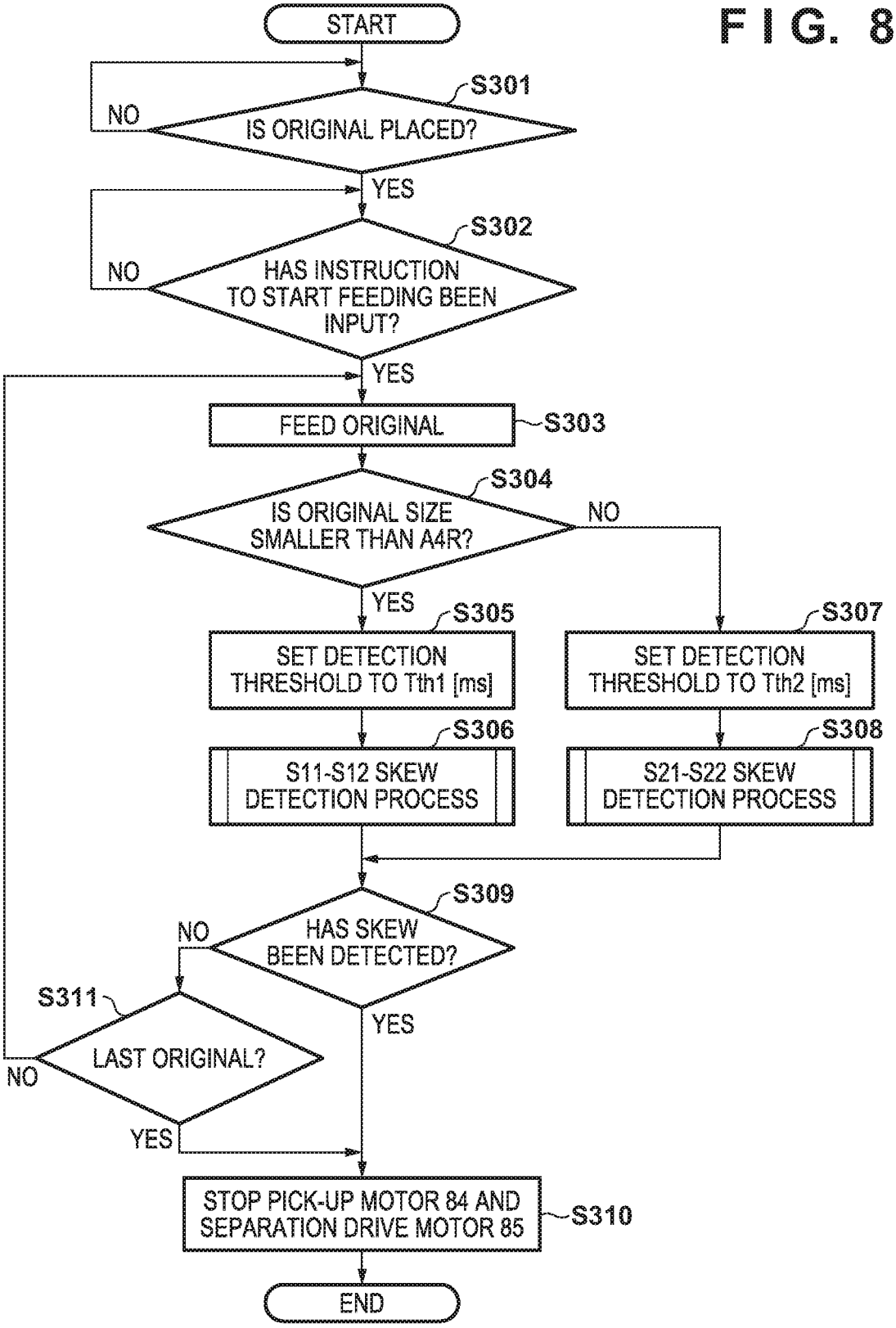
FIG. 8 is a flowchart showing operations according to a second embodiment.

Next, the second embodiment of the present invention will be described. In the second embodiment, the image forming apparatus basically has the same configuration as that of the first embodiment, but the operation flowchart thereof differs. In this embodiment, diagrams and descriptions are given of differences from the first embodiment. FIG. 8 is a flowchart of processing relating to detection of bound originals according to this embodiment that is performed by the CPU 81. In this embodiment, a value Tth2 corresponding to the distance between the skew detection sensors S21 and S22 is used as the threshold Tth.

Step S301 to step S304 of determining the original size in the flowchart according to the second embodiment in FIG. 8 are the same as step S101 to step S104 in the first embodiment, and a description thereof is omitted accordingly. If it is determined in step S304 that the original size is smaller than A4R (step S304: Yes), in step S306, the detection threshold Tth is set to Tth1, which is stored in the storage portion 507. On the other hand, if it is determined in step S304 that the original size is greater than or equal to A4R (step S304: No), in step S307, the detection threshold Tth is set to Tth2, which is stored in the storage portion 507. Here, the threshold Tth1 and the threshold Tth2 are values that are determined in accordance with the original conveyance speed. For example, values such as Tth1=30 [mS] and Tth2=45 [mS] may be employed. However, the values and the relationship regarding which of the thresholds is larger or smaller are not limited to those described here.

Nevertheless, since the distance between the skew detection sensors S21 and S22 is greater than the distance between the skew detection sensors S11 and S12, it is desirable to accordingly make the threshold Tth2 greater than the threshold Tth1. The threshold Tth2 is defined as being Tth1—(distance between S21 and S22/distance between S11 and S12), and the threshold Tth in the first embodiment may be replaced with this value. This is to match the tilt of the front edge according to which the occurrence of skewing is determined, with that in the case of processing in FIG. 5. Needless to say, since a sheet being conveyed often distorts as described with reference to FIGS. 7B and 7C, the threshold Tth2 may also be set accordingly.

After the threshold Tth1 has been set in step S305, the processing proceeds to step S306 to perform the S11-S12 skew detection process. The S11-S12 skew detection process here is the same as the S11-S12 skew detection process in step S105 in the first embodiment except that the detection threshold Tth is changed to Tth1, and a description thereof is omitted accordingly. After the detection threshold Tth is set to Tth2 stored in the storage portion 507 in step S307, the processing proceeds to step S308 to perform the S21-S22 skew detection process. The S21-S22 skew detection process here is the same as the S21-S22 skew detection process in step S106 in the first embodiment except that the detection threshold Tth is changed to Tth2, and a description thereof is omitted accordingly.

After the processing in step S307 or step S308 has been finished, it is determined whether or not skewing has been detected in step S307 or step S308 (step S309). The subsequent processing is the same as processing in steps S108 and S109 in the first embodiment, and a description thereof is omitted accordingly.

With the above-described procedure, the threshold for determining skewing is changed in accordance with the distance between sensors that constitute each skew detection sensor pair (sensor pair), and thus, skewing can be detected more accurately.

Third Embodiment

Figure 9:
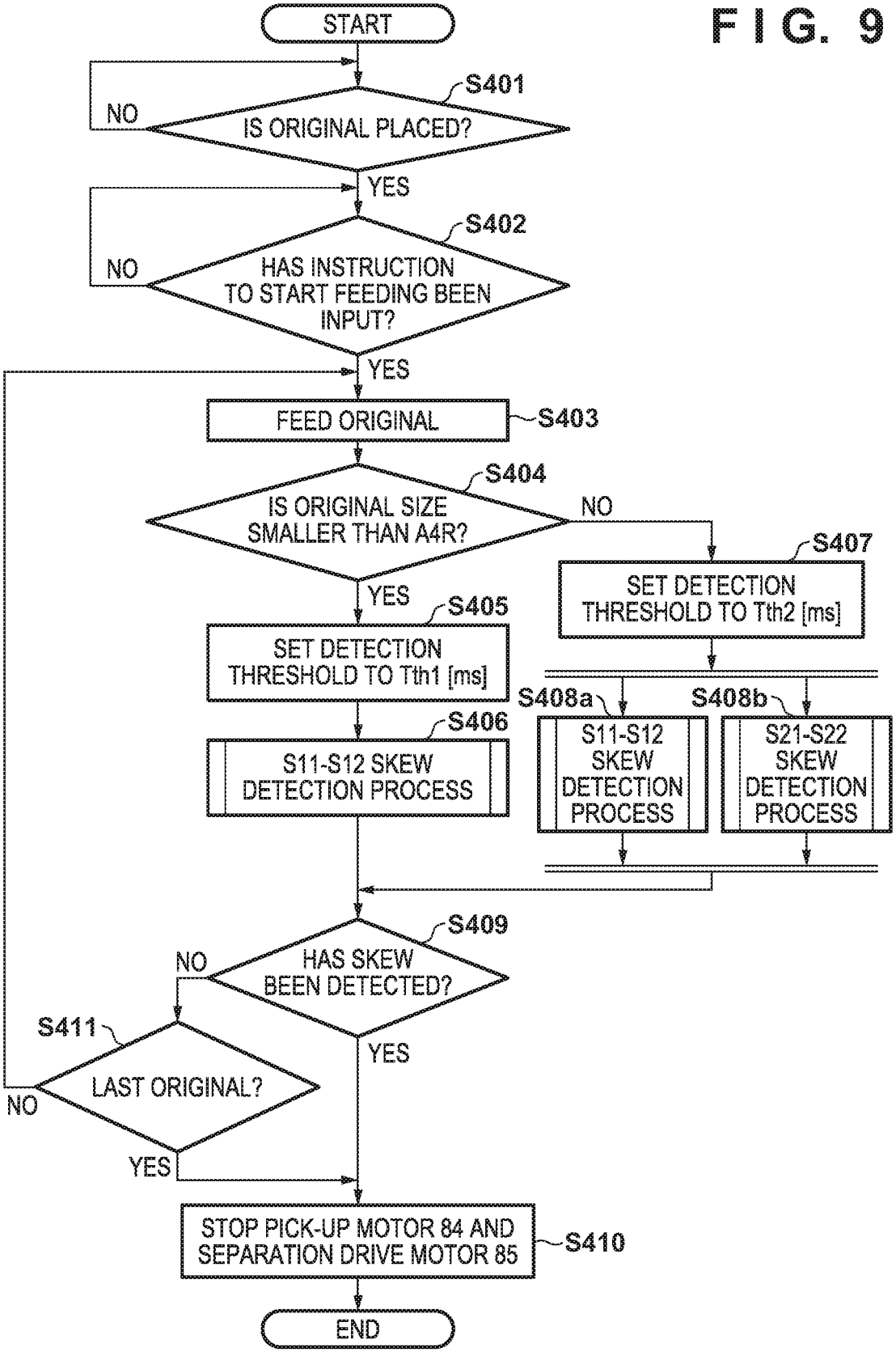
FIG. 9 is a flowchart showing operations according to a third embodiment.

Next, the third embodiment of the present invention will be described. The basic configuration of the third embodiment is the same as that of the second embodiment, but the operation flowchart thereof differs. In this embodiment, diagrams and descriptions are given of differences from the second embodiment. FIG. 9 is a flowchart relating to detection of bound originals according to this embodiment. The difference between FIG. 9 and FIG. 8, which is the flowchart of the second embodiment, lies in that, in FIG. 9, steps S408*a* and S408*b* are performed in place of step S308 in FIG. 8. The other steps are the same as those in the second embodiment, and a description thereof is omitted accordingly.

After the detection threshold Tth has been set to Tth2 stored in the storage portion 507 in step S407, steps S408*a* and S408*b* are performed in parallel. Step S408*a* is the same as the S11-S12 skew detection process in step S306 in the second embodiment, and step S408*b* is the same as the S21-S22 skew detection process in step S308 in the second embodiment. The reason why steps S408*a* and S408*b* are performed in parallel is because, although stapled large-size originals often skew as shown in FIG. 7B, skewing that is close to the ideal skewing shown in FIG. 7A can also be detected by the skew detection sensor pair S21-S22.

For this reason, if skewing is detected in either step S408*a* or step S408*b*, the other step may be stopped, and the processing may proceed to step S409. Note that, for example, a real-time operating system that controls the image forming apparatus 100 would usually have the ability to perform tasks in parallel, and therefore the tasks can be carried out under the control thereof.

The above-described configurations and processing make it possible to detect skewing of an original more quickly. This embodiment is particularly effective in the case of larger-size originals.

Fourth Embodiment

The following issue is raised if mixed originals with different widths is attempted to be handled in the above embodiments that use two pairs of sensors. "Mixed originals with different widths" refers to a state where originals with different sizes in the width direction are stacked on the original tray 21. In the case of increasing the number of sensor pairs for detecting originals to deal with respective original sizes as in the above embodiments, sensors are installed on two ends, in the width direction, of the originals to be detected, as much as possible, to increase the accuracy in detecting the skew tilt. Here, when mixed originals with different widths are to be read, these originals are usually placed on the original tray while aligning one side of the bundled originals with one of the regulating plates. To read the thus-aligned originals with different widths, a sensor for detecting larger-size originals that is located on the side opposite to the side where the originals are aligned is distant, to some extent, from a sensor for detecting smaller-size originals. For this reason, when mixed originals with different widths are to be read, if a small-size original is read, the sensor for detecting larger-size originals that is located on the side opposite to the side where the originals are aligned cannot detect the small-size original. Accordingly, even if the small-size original has been correctly conveyed in reality, it is determined that a large-size original is skewing, and conveyance of the original is stopped. For this reason, when mixed originals with different widths are to be read, the skew detection setting needs to be disabled, making the operation very bothersome for the user.

This embodiment employs a configuration described below. Note that the image forming apparatus 100 according to this embodiment may be the same as that of the first embodiment.

Skew Detection and Mixed Originals with Different Widths

Figure 10:
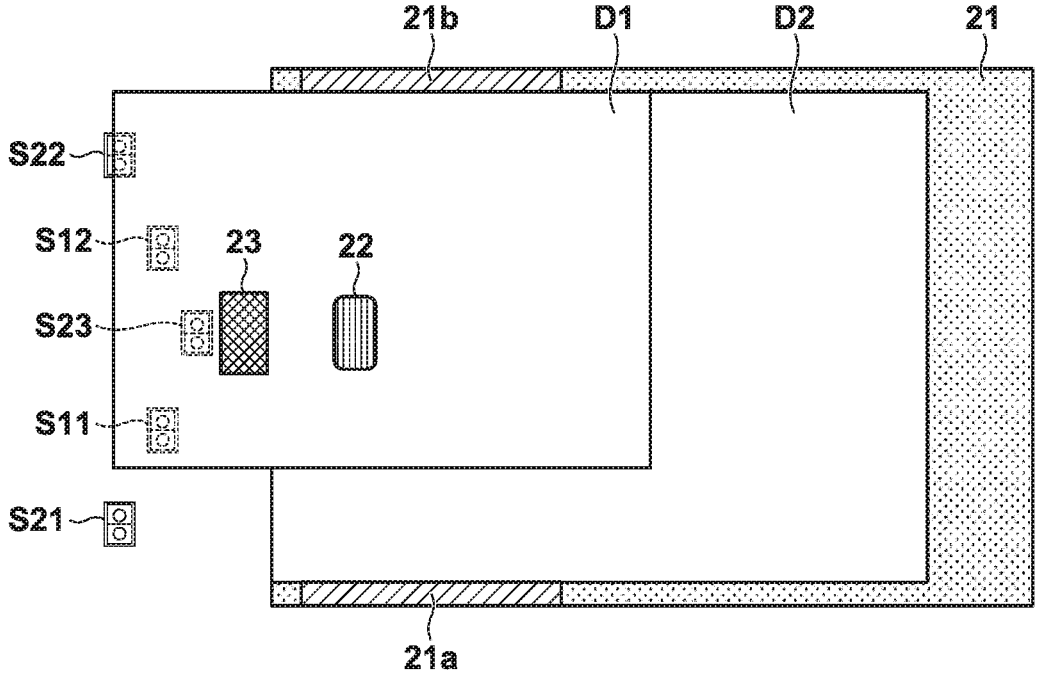
FIG. 10 illustrates an operation of an automatic original feeding portion of an image forming apparatus according to a fourth embodiment.

FIG. 10 schematically illustrates an operation of the ADF 20 according to this embodiment. A skew detection operation performed by the ADF 20 will be described below with reference to FIG. 10. FIG. 10 is a plan view of the original tray 21 of the ADF 20 and therearound viewed from above.

FIG. 10 shows mixed originals with different width sizes that are placed on and conveyed by the ADF 20. An operation performed for mixed originals with different widths will be described based on FIG. 10. Here, an original D1, which is a horizontally-placed A4 original, and an A3 original D2 are placed on the original tray 21. Thus, "placement of mixed originals with different widths" refers to a function of placing originals with lengths different in a direction (i.e. width direction) perpendicular to the conveyance direction to cause these originals to be read, and performing image formation processing corresponding to the respective sizes, using the ADF 20. To use the function of the placement of mixed originals with different widths, a set value for the placement of mixed originals with different widths needs to be set to ON. This setting of the placement of mixed originals with different widths is configured by the user making input to the operation portion 506. The setting of the placement of mixed originals with different widths may also be used as a default setting when the ADF 20 is used. This is a setting to automatically make the set value for the placement of mixed originals with different widths ON while assuming that the user is to use the ADF 20, if originals are placed on the original tray 21 of the ADF 20. As for the default setting of the placement of mixed originals with different widths, a default value can be set independently for each user if users are managed on the image forming apparatus.

In FIG. 10, the regulating plates 21*a* and 21*b* are arranged so as to be aligned with the larger-size original D2, and thus, the current size detected by the ADF 20 is the width size of the original D2. Thus, two pairs of skew detection sensors, namely the sensors S12 and S11 and the sensors S22 and S21 are used. In the case of the placement of mixed originals with different widths, skewing of the smaller-size original D1 cannot be prevented by holding the original D1 from two sides using the regulating plates 21*a* and 21*b*. For this reason, skewing is prevented by aligning a longitudinal side with either one of the regulating plates. Usually, a longitudinal side of the smaller-size original D1 is aligned with the regulating plate 21*a* located on the distal side of the original tray 21, i.e. the upper side of the diagram.

In FIG. 10, the small-size original D1 is conveyed in the mode of reading mixed originals with different widths. At this time, only the original D1 is conveyed leftward of the diagram by the pick-up roller 22 and the separation drive roller 23. Here, the sensor pair S12-S11 for smaller sizes in skew detection detect the original substantially simultaneously. However, of the sensor pair S22-S21 for large sizes, S22 is a sensor on the distal side and thus can detect the original, but S21 cannot detect the original because the smaller-size original does not have a sufficient length in the width direction. Accordingly, after the skew detection sensor S22 has detected the original, the skew detection sensor S21 cannot detect the original even after a given time based on which it is determined that skewing has been detected, and, as a result, it is determined that the original is skewing. This incorrect determination occurs when mixed originals with different widths are read. To avoid such an incorrect determination, for example, an operation to turn off the skew detection needs to be necessarily performed when mixed originals with different widths are to be read. This operation is very difficult for the user to understand, and is also bothersome, causing a problem in that the operability is degraded when mixed originals with different widths are to be read.

Operation Portion

Figure 12:
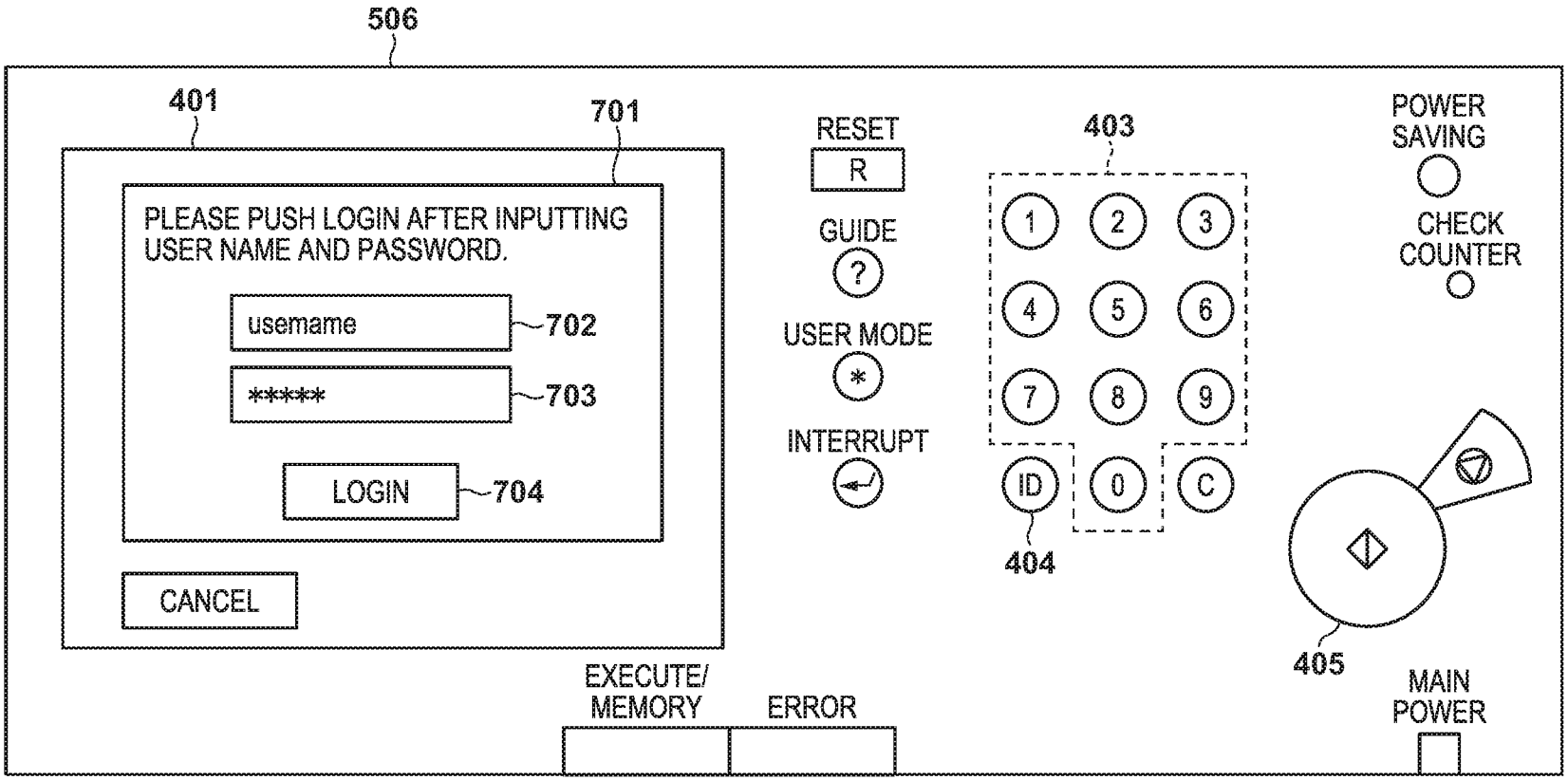
FIG. 12 shows an external appearance of an operation portion of an image forming apparatus according to a fifth embodiment.

First, the operation portion 506 will be described. Note that, although the operation portion 506 have not been specifically described in the first to fourth embodiments, the same operation portion 506 as that of this embodiment may be used. FIG. 12 shows an external appearance of the operation portion 506 of the image forming apparatus according to this embodiment. A display portion 401 displays various indications and settings of the apparatus on its screen, which is an LCD or the like. A touch panel is installed on the surface of the display portion 401, and accepts an input operation performed by the user. As a result of the user operating a software touch button or the like displayed on the display portion 401 via the touch panel, the CPU 81 determines the content of the user operation based on the coordinates of the pressed position on the touch panel and the displayed content, and performs processing according to the operation input. A ten key 403 is a physical key for inputting numerical values, such as a PIN number. An ID key 404 is a key for displaying an authentication screen to which a user ID and a password are to be input when users are managed on the image forming apparatus. A start key 405 is a key for giving an instruction to start a job, such as a copy job or a scan job. Note that the displayed screen is a user login screen, which will be described later.

Skew Detection Procedure

Figure 11:
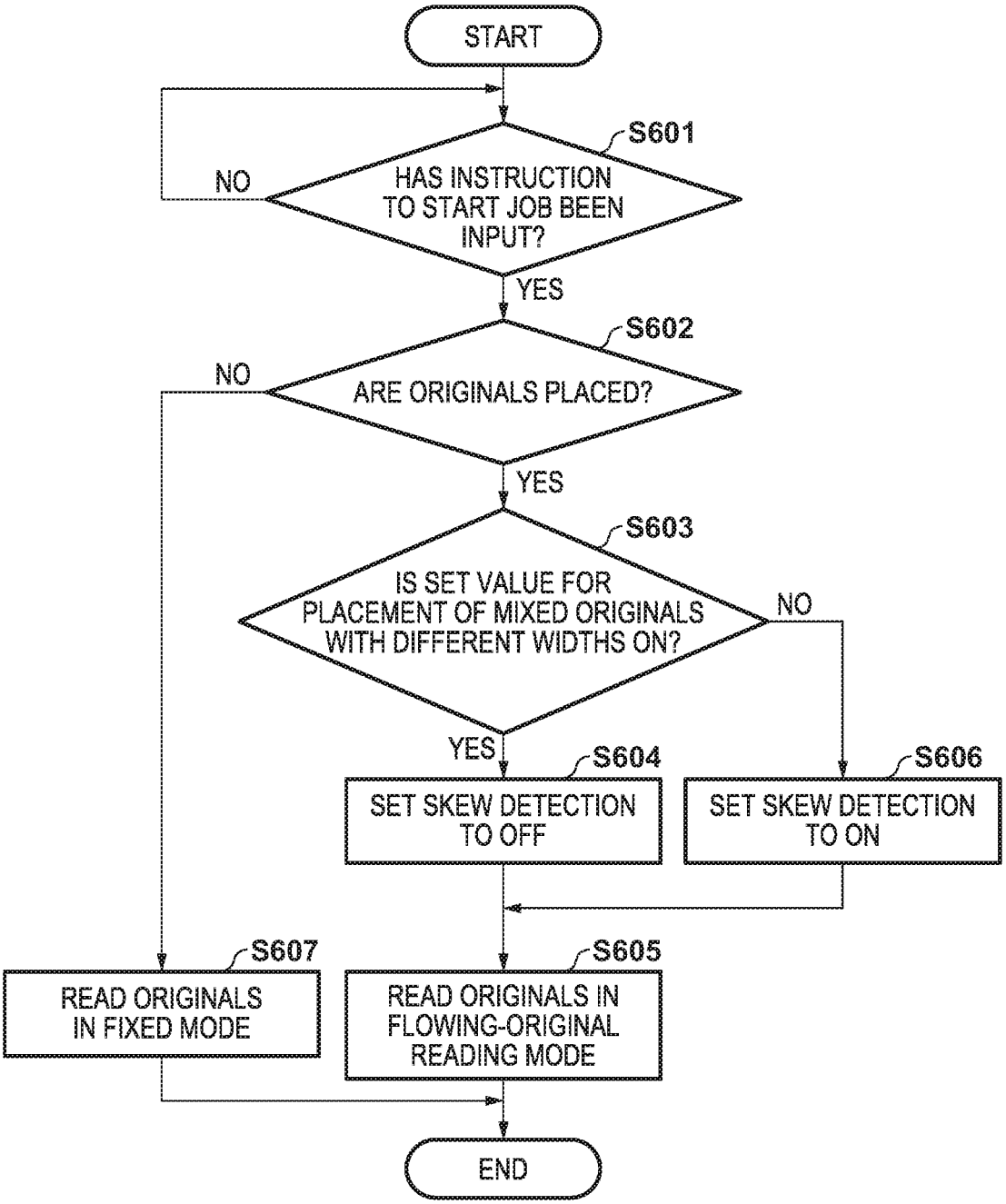
FIG. 11 is a flowchart showing processing performed by the image forming apparatus according to the fourth embodiment.

FIG. 11 is a flowchart showing processing performed by the control portion 80 of the image forming apparatus 100 according to this embodiment when reading originals. Steps in the flowchart in FIG. 11 are processed by the CPU 81 executing a program stored in the storage portion 507.

First, the control portion 80, specifically the CPU 81 determines whether or not an instruction to start a job that accompanies reading of originals, such as a copy job or a scan job, has been given by the user (S601). Specifically, it is determined whether or not an instruction has been given by pressing the start button 405 while a screen for configuring settings for copying or scanning is displayed on the operation portion 506. If it is determined that no instruction to execute a job has been given, step S601 is repeated to wait for a user instruction.

If it is determined in step S601 that an instruction to start executing a job such as a copy job or a scan job has been given, it is then determined whether or not originals are placed on the original tray 21 of the ADF 20 (S602). This determination is made by acquiring, from the ADF 20, information indicating whether or not the original detection sensor S31 has detected originals.

If it is determined that originals are set in the original tray 21, it is then determined whether or not a set value for the placement of mixed originals with different widths is currently ON (S603). The set value for the placement of mixed originals with different widths is set via the operation portion 506 by the user before job execution is started, and is temporarily stored in the storage portion 507.

If it is determined in step S603 that the set value for the placement of mixed originals with different widths is ON, a set value for original skew detection is set to OFF (S604). This setting may be made using any manner, e.g. a method in which the ADF 20 ignores original detection information from the skew detection sensors S12 to S21 to not perform skew detection processing itself, or a method in which the control portion 80 ignores a skew detection notification acquired from the reader unit 40. If it is determined in step S603 that the set value for the placement of mixed originals with different widths is not ON, the set value for the original skew detection is set to ON (S606). Thus, original skew detection of the ADF 20 is enabled.

After step S604 or S606, the ADF 20 performs original reading processing in the flowing-original reading mode (S605).

On the other hand, if it is determined in step S602 that no original is set in the original tray 21, the reader unit 40 reads originals in the fixed-original reading mode (S607). In reality, processing to be performed is determined based on whether or not an original is present on the original glass 41, set value conditions of the user, of the like, but a description thereof is omitted.

Thus, if the setting of the placement of mixed originals with different widths is ON, i.e. when a plurality of originals with different width sizes are read, and these originals are to be read by the ADF 20, skew detection itself can be automatically disabled to prevent the aforementioned incorrect detection of skewing. Also, if the setting of the placement of mixed originals with different widths is OFF, and originals are to be read by the ADF 20, skew detection is automatically enabled. Thus, the user does not need to enable or disable the skew detection function depending on the setting for the placement of mixed originals, and can always use skew detection if it can be used without giving consideration to use conditions or the like. Accordingly, operability for the user is improved when originals are read.

Fifth Embodiment

The hardware configuration and the control block configuration according to the fifth embodiment are the same as those described in the first embodiment, and a description thereof is omitted accordingly. The fifth embodiment will describe a method for controlling a set value employed when a default set value for the placement of mixed originals with different widths is set in the image forming apparatus 100 on which users are managed. Note that the fifth embodiment will only describes differences from the fourth embodiment.

In the fifth embodiment, users are managed on the image forming apparatus 100. User names for identifying users and passwords associated therewith are stored in the storage portion 507 of the control portion 80. Each user is authenticated by inputting a user name and a password before using the apparatus, and if the user is successfully authenticated, the user can also use the apparatus with set values for each user stored in the storage portion 507 reflected. The aforementioned default value for the placement of mixed originals with different widths is one of the set values for each user.

FIG. 12 shows an example of a user authentication screen displayed on the display portion 401 of the operation portion 506 in the fifth embodiment. This user authentication screen is displayed as the result of a user pressing the ID key 404 in the operation portion 506 before using the apparatus. A user name input portion 702, a password input portion 703, and a login button 704 are displayed in an authentication dialog 701. Upon the user name input portion 702 being pressed, a software keyboard dialog is displayed on the display portion 401, making it possible to input a user name. The input user name is displayed in the user name input portion 702 after the software keyboard dialog is closed.

Upon the password input portion 703 being pressed, a software keyboard dialog is displayed similarly, making it possible to input a password similarly. If a set password only includes numerals, the software keyboard dialog is not displayed, and the password can also be directly input using the ten key 403. After the password has been input, symbols such as "***" is displayed in place of characters in the password input portion 703**, and thus it can be understood that the password has been input.

The login button 704 is a button for authenticating the user after the user name and the password have been input. After the login button 704 has been pressed, it is checked whether or not the input user name and password match a pair of user name and password stored in the storage portion 507. If the input user name and password agree with the stored pair, this authentication dialog 701 is closed and a setting screen is displayed. At this time, if set values for each user are stored in the storage portion 507, the setting screen is displayed while reflecting these set values. If authentication fails, a massage indicating that authentication has failed is displayed on the authentication dialog 701, and the user is prompted to input a user name and a password again.

Skew Detection Procedure

Figure 13:
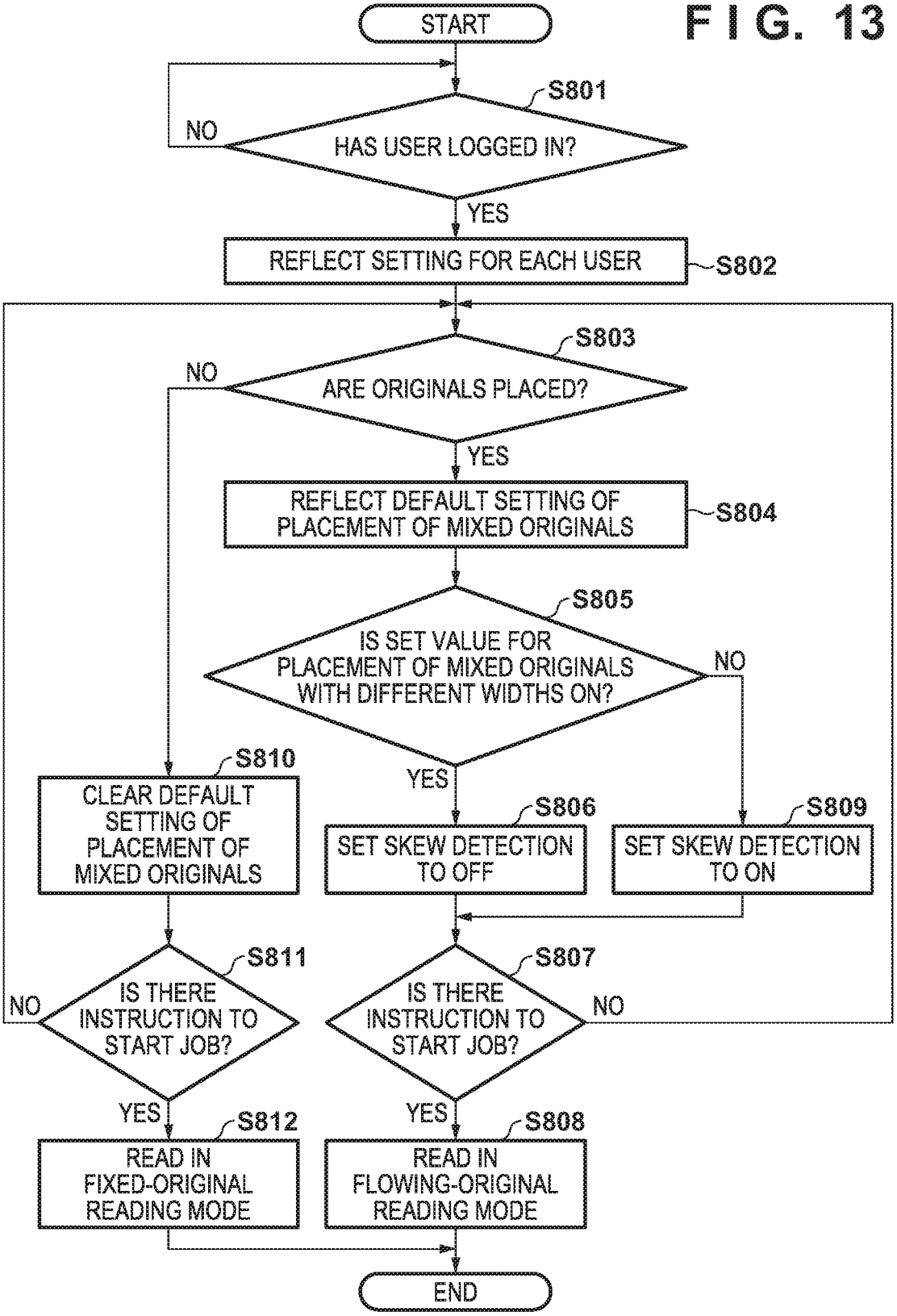
FIG. 13 is a flowchart showing processing performed by the image forming apparatus according to the fifth embodiment.

FIG. 13 is a flowchart showing processing performed by the control portion 80 when reading originals in the fifth embodiment. Steps in the flowchart in FIG. 13 are processed by the CPU 81 executing a program stored in the storage portion 507.

First, the control portion 80, specifically the CPU 81 determines whether or not the user has logged in by being authenticated (S801). Specifically, it is determined whether or not the login button 704 in the authentication dialog 701 has been pressed, and whether or not the user name and the password match in the user authentication performed after it has been determined that the login button 704 was pressed. If it is determined that the user has not logged in, step S801 is repeated to wait for a user instruction. Note that, if authentication is performed by another device, the names of logged-in users or the like stored in a predetermined storage location are referenced, and it may be determined that the user has logged in if the user name is stored.

If it is determined in step S801 that the user has logged in, the set values for the logged-in user is read out from the storage portion 507, and the setting screen is displayed after reflecting the read set values (S802).

Next, it is determined whether or not originals are placed on the original tray 21 of the ADF 20 (S803). This is the same processing as that in step S602 in FIG. 11 in the fourth embodiment. Here, if it is determined that originals are placed, a default mixture setting for the user who is currently logged in is reflected in the set values stored for the user (S804).

Furthermore, it is determined whether or not the set value for the placement of mixed originals with different widths in the configured default setting of the placement of mixed originals is ON (S805). This is the same processing as that in step S603 in FIG. 11 in the fourth embodiment.

If it is determined in step S805 that the set value for the placement of mixed originals with different widths is ON, the skew detection setting is turned OFF (S806). On the other hand, if the set value for the placement of mixed originals with different widths is OFF, the skew detection setting is turned ON (S809). Processing in these steps is the same as processing in steps S604 and S606, respectively, in FIG. 11 in the fourth embodiment.

After the processing in step S806 or step S809, it is determined whether or not an instruction to start executing a job such as a copy job or a scan job has been given by the user (S807). This is the same processing as that in step S601 in FIG. 11 in the fourth embodiment. If it is determined in step S807 that no user instruction has been given, the processing returns to step S803 to wait for a user instruction. If it is determined in step S807 that a user instruction has been given, processing to read the originals in the flowing-original reading mode is performed (S808). This is the same processing as that in step S605 in FIG. 11 in the fourth embodiment.

If it is determined in step S803 that no original is placed, the default setting of the placement of mixed originals of the user who is currently logged in is cleared in the set values stored for the user (S810). Thus, if no original is set, regarding the setting of the placement of mixed originals, the setting of the placement of mixed originals is configured such that the set values including that for the placement of mixed originals with different widths are set to OFF. Next, it is determined whether or not an instruction to start executing a job such as a copy job or a scan job has been given by the user (S811). This step is the same as the aforementioned step S808 and step S601 in FIG. 11 in the fourth embodiment. If it is determined in step S811 that no user instruction has been given, the processing returns to step S803 to wait for a user instruction. If it is determined in step S811 that a user instruction has been given, processing to read the originals in the fixed-original reading mode is performed (S812). This is the same processing as that in step S607 in FIG. 11 in the fourth embodiment.

As described above, even if users are managed and set values for a user is automatically reflected upon the user logging in, it is possible to change, without inconsistency, two set values that may cause a malfunction if both values are set at the same time, such as the placement of mixed originals with different widths and the skew detection setting. Thus, the user can use the two functions after logging in without being particularly conscious of these two set values, and convenience and operability are improved.

OTHER EMBODIMENTS

In the above embodiments, the skew detection sensor pair S21-S22 are provided downstream of the skew detection sensor pair S11-S12, but the skew detection sensor pair S11-S12 may alternatively be provided on the downstream side, or both sensor pairs may be provided at the same position in the conveyance direction.

Embodiment(s) of the present invention can also be realized by a computer of a system or apparatus that reads out and executes computer executable instructions (e.g., one or more programs) recorded on a storage medium (which may also be referred to more fully as anon-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-046383, filed Mar. 13, 2019, which is hereby incorporated by reference herein in its entirety.

What is claimed is:

1. A sheet feeder apparatus comprising:

a sheet placement portion on which sheets are placed;

a width detection unit configured to detect a width of a sheet placed on the sheet placement portion;

a conveyance unit configured to convey sheets placed on the sheet placement portion while separating the sheets one by one;

a first sensor configured to detect a sheet conveyed by the conveyance unit at a first position;

a second sensor configured to detect a sheet conveyed by the conveyance unit at a second position that differs from the first position in a width direction perpendicular to a conveyance direction;

a third sensor configured to detect a sheet conveyed by the conveyance unit at a third position that is between the first position and the second position in the width direction;

a fourth sensor configured to detect a sheet conveyed by the conveyance unit at a fourth position that is between the first position and the second position in the width direction and differs from the third position in the width direction; and a control unit configured to determine that skewing of a sheet has occurred in a case in which the width of the sheet detected by the width detection unit is a first width and one of the first sensor and the second sensor does not detect the sheet within a first time period from a time when the other of the first sensor and the second sensor detects the sheet, the first width being longer than a distance between the first position and the second position in the width direction, and determine that skewing of a sheet has occurred in a case in which the width of the sheet detected by the width detection unit is a second width and one of the third sensor and the fourth sensor does not detect the sheet within a second time period from a time when the other of the third sensor and the fourth sensor detects the sheet, the second width being longer than a distance between the third position and the fourth position in the width direction and being shorter than the distance between the first position and the second position in the width direction, wherein the control unit does not determine skewing of a sheet based on a detection result of the first sensor, the second sensor, the third sensor, and the fourth sensor if a setting of placement of mixed sheets of a plurality of different widths on the sheet placement portion has been made.

2. The sheet feeder apparatus according to claim 1, wherein, if the width of the sheet detected by the width detection unit is the first width, the control unit determines that skewing of the sheet has occurred based on signals from the third sensor and the fourth sensor, in addition to signals from the first sensor and the second sensor.

3. The sheet feeder apparatus according to claim 2, wherein, if the width of the sheet detected by the width detection unit is the first width, the control unit performs, in parallel, the determination of skewing of the sheet based on signals from the first sensor and the second sensor, and the determination of skewing of the sheet based on signals from the third sensor and the fourth sensor.

4. The sheet feeder apparatus according to claim 1, wherein the first time period is longer than the second time period.

5. The sheet feeder apparatus according to claim 1, wherein the first position and the second position are at a same distance in the conveyance direction, and the third position and the fourth position are at a same distance in the conveyance direction.

6. The sheet feeder apparatus according to claim 1, wherein the first position and the second position are arranged downstream, in the conveyance direction, of the third position and the fourth position.

7. The sheet feeder apparatus according to claim 1, further comprising:

a unit configured to detect a sheet placed on the sheet placement portion; and a storing unit configured to store the setting of the placement of mixed sheets in a case in which the sheet is placed on the sheet placement portion, wherein, if the sheet placed on the sheet placement portion is detected, the control unit disables or does not disable the determination of skewing of the sheet, depending on the setting of the placement of mixed sheets stored in the storing unit.

8. The sheet feeder apparatus according to claim 7, further comprising:

a unit configured to enable a user to log in, wherein the setting of the placement of mixed sheets in a case in which the sheet is placed on the sheet placement portion is stored in the storing unit in association with a user, and if the sheet placed in the sheet placement portion is detected, the control unit disables or does not disable the determination of skewing of the sheet, depending on the setting of the placement of mixed sheets stored in the storing unit in association with a logged-in user.

9. The sheet feeder apparatus according to claim 1, wherein, if the control unit determines that skewing of a sheet has occurred, the control unit causes the conveyance unit to stop conveying the sheet.

10. The sheet feeder apparatus according to claim 1, further comprising:

two regulating plates configured to contact with two end portions of a sheet, wherein the width detection unit detects the width of the sheet based on a distance between the two regulating plates in the width direction.

11. A sheet feeder apparatus comprising:

a sheet placement portion on which sheets are placed;

a width detection unit configured to detect a width of a sheet placed on the sheet placement portion;

a conveyance unit configured to convey sheets placed on the sheet placement portion while separating the sheets one by one;

a first sensor configured to detect a sheet conveyed by the conveyance unit at a first position;

a second sensor configured to detect a sheet conveyed by the conveyance unit at a second position that differs from the first position in a width direction perpendicular to a conveyance direction;

a third sensor configured to detect a sheet conveyed by the conveyance unit at a third position that is between the first position and the second position in the width direction;

a fourth sensor configured to detect a sheet conveyed by the conveyance unit at a fourth position that is between the first position and the second position in the width direction and differs from the third position in the width direction; and a control unit configured to cause the conveyance unit to stop conveying a sheet in a case in which the width of the sheet detected by the width detection unit is a first width and one of the first sensor and the second sensor does not detect the sheet within a first time period from a time when the other of the first sensor and the second sensor detects the sheet, the first width being longer than a distance between the first position and the second position in the width direction, and cause the conveyance unit to stop conveying a sheet in a case in which the width of the sheet detected by the width detection unit is a second width and one of the third sensor and the fourth sensor does not detect the sheet within a second time period from a time when the other of the third sensor and the fourth sensor detects the sheet, the second width being longer than a distance between the third position and the fourth position in the width direction and being shorter than the distance between the first position and the second position in the width direction, wherein the first position and the second position are at a same distance in the conveyance direction and are arranged downstream, in the conveyance direction, of the third position and the fourth position, and wherein the third position and the fourth position are at a same distance in the conveyance direction.

12. An image scanning apparatus comprising:

a sheet placement portion on which sheets are placed;

a conveyance unit configured to convey sheets placed on the sheet placement portion while separating the sheets one by one;

a reader unit configured to read an image on a sheet conveyed by the conveyance unit;

a first sensor configured to detect a sheet conveyed by the conveyance unit at a first position;

a second sensor configured to detect a sheet conveyed by the conveyance unit at a second position that differs from the first position in a width direction perpendicular to a conveyance direction;

a third sensor configured to detect a sheet conveyed by the conveyance unit at a third position that is between the first position and the second position in the width direction;

a fourth sensor configured to detect a sheet conveyed by the conveyance unit at a fourth position that is between the first position and the second position in the width direction and differs from the third position in the width direction; and a control unit configured to cause the conveyance unit to stop conveying a sheet in a case in which the width of the sheet conveyed by the conveyance unit is a first width and one of the first sensor and the second sensor does not detect the sheet within a first time period from a time when the other of the first sensor and the second sensor detects the sheet, the first width being longer than a distance between the first position and the second position in the width direction, and cause the conveyance unit to stop conveying a sheet in a case in which the width of the sheet conveyed by the conveyance unit is a second width and one of the third sensor and the fourth sensor does not detect the sheet within a second time period from a time when the other of the third sensor and the fourth sensor detects the sheet, the second width being longer than a distance between the third position and the fourth position in the width direction and being shorter than the distance between the first position and the second position in the width direction, wherein the control unit causes the conveyance unit to convey a sheet regardless of a detection result of the first sensor, the second sensor, the third sensor, and the fourth sensor if a setting of placement of mixed sheets having a plurality of different widths on the sheet placement portion has been made.

13. The image scanning apparatus according to claim 12, further comprising:

a width detection unit configured to detect a width of a sheet placed in the sheet placement portion.

14. The image scanning apparatus according to claim 12, wherein the first position and the second position are at a same distance in the conveyance direction, and the third position and the fourth position are at a same distance in the conveyance direction.

* * * * *